US006279369B1

(12) United States Patent
Kasuya

(10) Patent No.: US 6,279,369 B1
(45) Date of Patent: Aug. 28, 2001

(54) PIPE BENDING METHOD AND MANDREL ASSEMBLY FOR CARRYING OUT THE METHOD

(75) Inventor: Atsuo Kasuya, Sayama (JP)

(73) Assignee: Honda Giken Kogyo Kubushiki Kaisha, Tokyo (JP)

( * ) Notice: Subject to any disclaimer, the term of this patent is extended or adjusted under 35 U.S.C. 154(b) by 0 days.

(21) Appl. No.: 09/461,122

(22) Filed: Dec. 14, 1999

(30) Foreign Application Priority Data

Dec. 14, 1998 (JP) ..... 10-355169
Jul. 8, 1999 (JP) ..... 11-194742

(51) Int. Cl.[7] ..... B21D 9/01
(52) U.S. Cl. ..... 72/369; 72/466.2
(58) Field of Search ..... 72/369, 466, 466.2

(56) References Cited

U.S. PATENT DOCUMENTS 174,608 * 3/1876 Wright ..... 72/466
2,117,724 * 5/1938 Ibbetson et al. ..... 72/466

FOREIGN PATENT DOCUMENTS 6-339731 * 12/1994 (JP) .

* cited by examiner

*Primary Examiner*—Lowell A. Larson
(74) *Attorney, Agent, or Firm*—Merchant & Gould P.C.

(57) ABSTRACT

A first mandrel segment comprised of first and second resinous sheets including proximal end portions vertically spaced from each other is initially inserted into a pipe having a weld seam extending longitudinally thereof. Since the first mandrel segment has a thickness smaller than an inside measurement of the pipe, the first mandrel segment can be inserted into the pipe without being caught by a bulged portion of the weld seam protruding inwardly of the pipe. After the insertion of the first mandrel segment, a second mandrel segment comprised of a third resinous sheet is forced into a spacing between the first and second resinous sheets. By thus forcing the third resinous sheet into the spacing, the first resinous sheet is pushed vertically to come into intimate contact with the bulged portion. The pipe having the first, second, and third resinous sheets thus inserted therewithin is then bent by a bender. After the bending of the pipe, the third resinous sheet is first pulled out of the bent pipe. The first and second resinous sheets are subsequently pulled out of the bend pipe.

7 Claims, 11 Drawing Sheets

48
L1
40
41
42
47
11
12
1A
13
①

3C
3C
40
42
11
12
15
31
38
35
34
32
②

40
11
12
21
46
46a
41
42
Y2

PIPE BENDING METHOD AND MANDREL ASSEMBLY FOR CARRYING OUT THE METHOD

BACKGROUND OF THE INVENTION

1. Field of the Invention

The present invention relates to a method for bending a pipe formed by welding and to a mandrel assembly for use in being such a pipe.

2. Description of the Related Art

A hollow workpiece such as a pipe is typically bent with a mandrel inserted thereinto to provide the hollow workpiece with a bent portion free from such deformation as buckling and with a constant inner diameter throughout the length thereof. However, from time to time, the insertion of the mandrel does not provide sufficient effect upon bending of the hollow workpiece. As a result, the hollow workpiece undesirably includes wrinkly deformation at the bent portion thereof.

To overcome this problem, there has been proposed a hollow workpiece bending apparatus as disclosed in, for example, Japanese Patent Laid-Open Publication No. HEI-6-339731.

A hollow workpiece to be bent in such an apparatus is a seamless pipe of aluminum. A mandrel to be inserted into such a pipe is made of nylon and is sized to fit into the pipe. The mandrel inserted within the pipe extends forwardly through a workpiece-introducing aperture of a stationary die into a workpiece-introducing aperture of a movable die provided forwardly of the stationary die, such that a front end thereof is positioned at a central portion of the workpiece-introducing aperture. One supporting bar is connected to a rear end of the mandrel in support of the same.

Since the mandrel is an extruded product of nylon and extends into the workpiece-introducing aperture of the movable die, the hollow workpiece includes a portion to be bent which is supported by the mandrel inserted therewithin. Thus, it becomes possible for the bending apparatus to bend such a portion of the hollow workpiece without causing undesirable deformation such as buckle thereon. This bending apparatus is useful especially in providing a product including a bent portion of small radius or curvature.

However, the mandrel used in the aforementioned bending apparatus is designed to fit into the extruded hollow workpiece. Therefore, such a mandrel is less applicable to a weld tube having a bead including a projection or bulged portion protruding inwardly of the weld tube. If the mandrel is made thinner in correspondence to the bulged portion, the pipe inevitably includes very large gaps between a surface of the mandrel and inner surfaces thereof adjacent the surface of the bulged portion. This makes it difficult to precisely bend the pipe. Alternatively, one may propose provision of the mandrel with a recessed portion formed in conformation to the bulged portion, however, such a mandrel would become expensive.

SUMMARY OF THE INVENTION

An object of the present invention is to provide a preferred method of bending a pipe having a weld seam.

A further object of the present invention is to provide a preferred mandrel assembly for use in bending the pipe having the weld seam.

According to a first aspect of the present invention, there is provided a method of bending a pipe with a mandrel inserted therewithin, the pipe having a weld seam extending longitudinally thereof, the weld seam including a bulged portion protruding inwardly of the pipe, the method comprising the steps of: providing plural resinous sheets for forming the mandrel having a thickness corresponding to an inside measurement of the pipe when the mandrel is inserted within the pipe; inserting a part of the resinous sheets into the pipe; inserting the rest of the resinous sheets into the pipe such that a surface of the part of the resinous sheets comes into intimate contact with the bulged portion; actuating a bender to apply pressure to the pipe to thereby bend the pipe with the part and the rest of the resinous sheets inserted therewithin; pulling the rest of the resinous sheets out of the bent pipe; and pulling the part of the resinous sheets out of the bent pipe after pulling the rest of the resinous sheets out of the bent pipe.

The part of the resinous sheets is initially inserted into a pipe having a weld seam extending longitudinally thereof. Since the part of the resinous sheets in small in thickness, the part of the resinous sheets can be inserted into the pipe without being caught by the bulged portion of the weld seam. Thus, these resinous sheets are not damaged by the bulged portion. Afterwards, the rest of resinous sheets is inserted into the pipe to thereby push the previously inserted resinous sheets against the bulged portion. Because the mandrel can be readily inserted into the pipe without being influenced by the bulged portion of the weld seam, the present invention is suitable for the bending of the pipe having the weld seam. More specifically, it is not necessary to provide the mandrel with any recessed portion formed in correspondence to the bulged portion of the weld seam. This makes it possible to reduce the cost of the mandrel. After bending the pipe, the above-mentioned resinous sheets are pulled out of the pipe in reverse sequence of insertion of the resinous sheets into the pipe. The pipe may be circular in cross-section.

According to a second aspect of the present invention, there is provided a method of bending a pipe of rectangular cross-section with a mandrel inserted therewithin, the pipe including top and bottom sheets either of which has a weld seam extending longitudinally thereof, the weld seam having a bulged portion protruding inwardly of the top or bottom sheet, the method comprising the steps of: providing plural resinous sheets for forming the mandrel having a thickness corresponding to an inside measurement between the top and bottom sheets when the mandrel is inserted within the pipe; inserting a part of the resinous sheets into the pipe; inserting the rest of the resinous sheets into the pipe such that a surface of the part of the resinous sheets comes into intimate contact with the bulged portion; actuating a bender to apply pressure to the top or bottom sheet of the pipe to thereby bend the top or bottom sheet with the part and the rest of the resinous sheets inserted therewithin; pulling the rest of the resinous sheets out of the bent pipe; and pulling the part of the resinous sheets out of the bent pipe after pulling the rest of the resinous sheets out of the bent pipe.

The pipe to be bent in accordance with the present invention is rectangular in cross-section. Such a pipe includes top and bottom sheets either of which has a weld seam. A part of plural resinous sheets for forming the mandrel is initially inserted into the pipe of rectangular cross-section. The thickness of the part of the resinous sheets is smaller than the inside measurement of the pipe. Accordingly, the part of the resinous sheets can be inserted into the pipe without being caught by the bulged portion of the weld seam protruding inwardly of the pipe. As a result, these resinous sheets are not damaged by the bulged portion.

When pulling the resinous sheets out of the bent pipe after the bending of the pipe, the rest of the resinous sheets is first pulled out of the bent pipe.

According to a third aspect of the present invention, there is provided a mandrel assembly designed to be inserted into a pipe for bending the pipe, the pipe having a weld seam extending longitudinally thereof, the weld seam including a bulged portion protruding inwardly of the pipe, the mandrel assembly comprising: a first mandrel segment to be initially inserted into the pipe, the first mandrel segment being comprised of at least one resinous sheet; and a second mandrel segment comprised of one resinous sheet to be inserted into the pipe after the insertion of the first mandrel segment into the pipe such that the second mandrel segment brings a surface of the first mandrel segment into intimate contact with the bulged portion.

In a preferred form of the present invention, when the first and second mandrel segments are inserted into the pipe, thickness of the first and second mandrel segments are substantially equal to an inside measurement of the pipe.

In a further preferred form of the present invention, the first mandrel segment comprises first and second resinous sheets including proximal end portions vertically spaced from each other while the second mandrel segment comprises a third resinous sheet to be inserted between the first and second resinous sheets.

In a still further preferred form of the present invention, when the pipe is rectangular in cross-section, the first, second, and third resinous sheets are flat resinous sheets.

In a yet further preferred form of the present invention, when the pipe is circular in cross-section, each of the first and second resinous sheets has a flat surface and an arced surface such that each cross-section of the first and second resinous sheets is sized in substantial correspondence to an inner diameter of the pipe while the third resinous sheet is a flat resinous sheet having opposite side surfaces arced in substantial correspondence to the inner diameter of the pipe.

BRIEF DESCRIPTION OF THE DRAWINGS

Certain preferred embodiments of the present invention will hereinafter be described in detail, by way of example only, with reference to the accompanying drawings, in which:

FIG. 3C is an enlarged cross-sectional view takes along line 3C—3C of FIG. 3B, and FIG. 3E is an enlarged cross-sectional view taken along line 3E—3E of FIG. 3D;

FIG. 5A illustrates a third resinous sheet pulled out of the bent pipe while

FIG. 7B is an enlarged cross-sectional view taken along line 7B—7B of FIG. 7A, and FIG. 7D is an enlarged cross-sectional view taken along line 7D—7D of FIG. 7C;

DETAILED DESCRIPTION OF THE PREFERRED EMBODIMENTS

The following description is merely exemplary in nature and is in no way intended to limit the invention or its application or uses.

Figure 1:
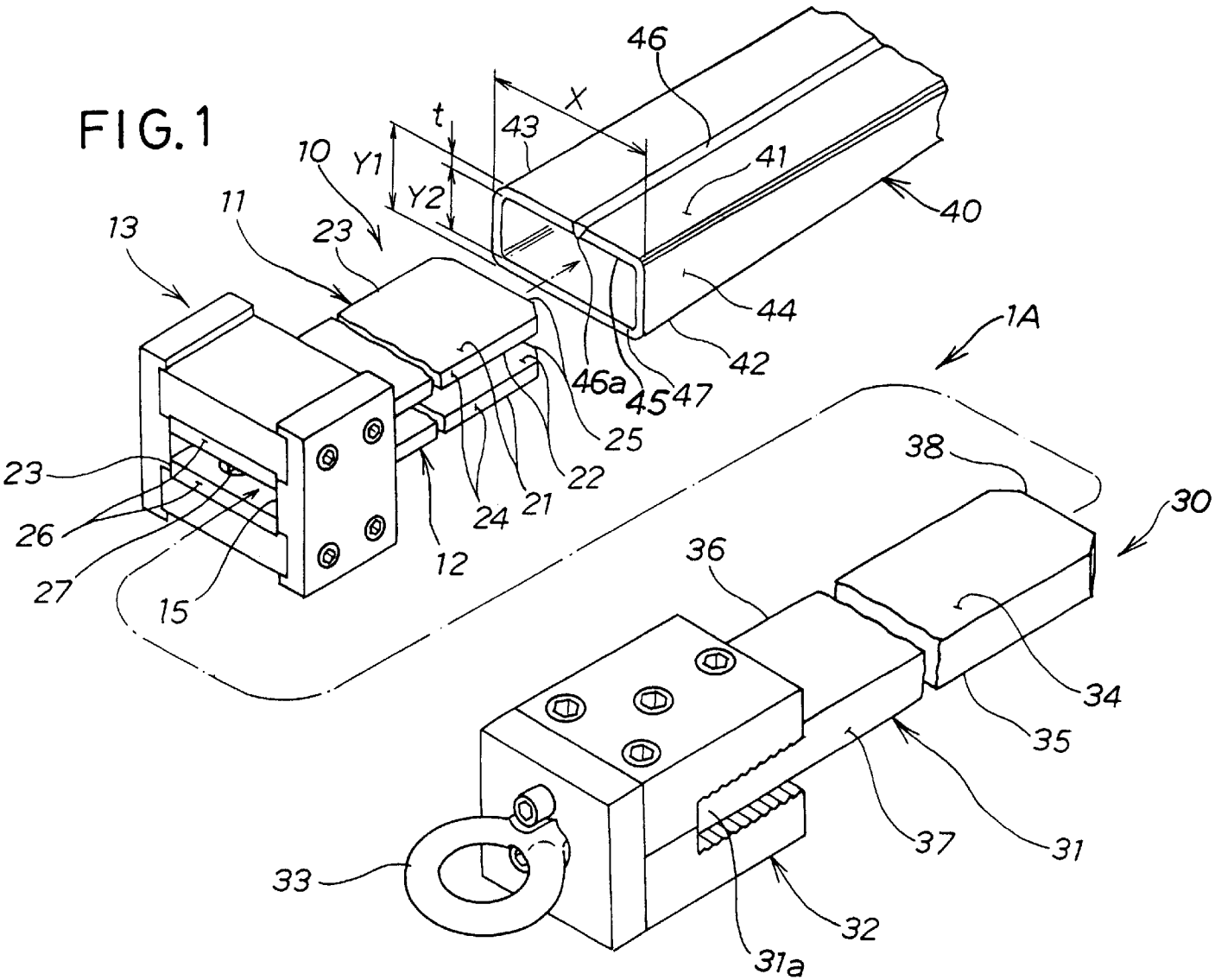
FIG. 1 is a perspective view of a mandrel assembly for use in a first embodiment of the present invention.

FIG. 1 illustrates a mandrel assembly 1A for a hollow workpiece 40 to be bent according to a first embodiment of the present invention. The hollow workpiece 40 is a pipe of rectangular cross-section. The mandrel assembly 1A comprises a first mandrel segment 10 and a second mandrel segment 30.

The first mandrel segment 10 includes first and second elongated resinous sheets 11, 12. The first and second resinous sheets 11, 12 are made from resin of polyamide.

The first and second resinous sheets 11, 12 include proximal end portions 26, 26. The proximal end portions 26, 26 are spaced from each other by a predetermined interval and secured to a supporting member 13 by means of screws 27, 27 (the screw 27 in the proximal end portion 26 of the first resinous sheet 11 is not shown). Between the proximal end portions 26, 26 of the first and second resinous sheets 11, 12, there is defined an opening 15 sized such that the second mandrel segment 30 is inserted thereinto.

The elongated resinous sheets 11, 12 include front surfaces 21, 21, back surfaces 22, 22, left side surfaces 23, 23, right side surfaces 24, 24, and distal end portions 25, 25. Either of the front surfaces 21, 21 of the first and second resinous sheets 11, 12 is disposed to contact a bead 46 serving as a seam of the pipe 40. The back surfaces 22, 22 of the first and second resinous sheets 11, 12 are disposed in opposed relation to each other.

The second mandrel segment 30 comprises a third resinous sheet 31 to be inserted into the opening 15. The third resinous sheet 31 as well as the first and second resinous sheets 11, 12 is made from resin of polyamide. The third resinous sheet 31 includes a proximal end portion 31*a* sandwiched between two members of a holding tool 32 of metal. The holding tool 32 is provided with an annular handle 33. The third resinous sheet 31 includes back-up surfaces 34, 35, a left side surface 36, a right side surface 37, and a distal end portion 38. Upon insertion of the third resinous sheet 31 between the first and second resinous sheets 11, 12, the back-up surfaces 34, 35 act to push the first and second resinous sheets 11, 12 upwardly and downwardly.

The hollow workpiece 40 is a pipe of rectangular cross-section including a top sheet portion 41, a bottom sheet portion 42, a left side sheet portion 43, and a right side sheet portion 44. Although the top sheet portion 41 includes the bead 46 formed by seam welding and extending longitudinally thereof in the illustrated embodiment, such a bead 46 may be formed in the bottom sheet portion 42. The bead 46 includes a projection or bulged portion 46*a* protruding inwardly from an interior surface 45 of the top sheet portion 41. The pipe 40 has a cross-section sized to have a width X of, for example, 70 mm and a height Y1 of, for example, 35 mm. The top sheet portion 41 has a thickness t of, e.g., 3.7 mm. An inside measurement Y2 between the interior surface 45 of the top sheet portion 41 and the interior surface of the bottom sheet portion 42 is, for example, 27.6 mm. Designated by reference number 47 is a distal end portion of the hollow workpiece 40. A mandrel is inserted into the pipe 40 through such a distal end portion 47.

Figure 2:
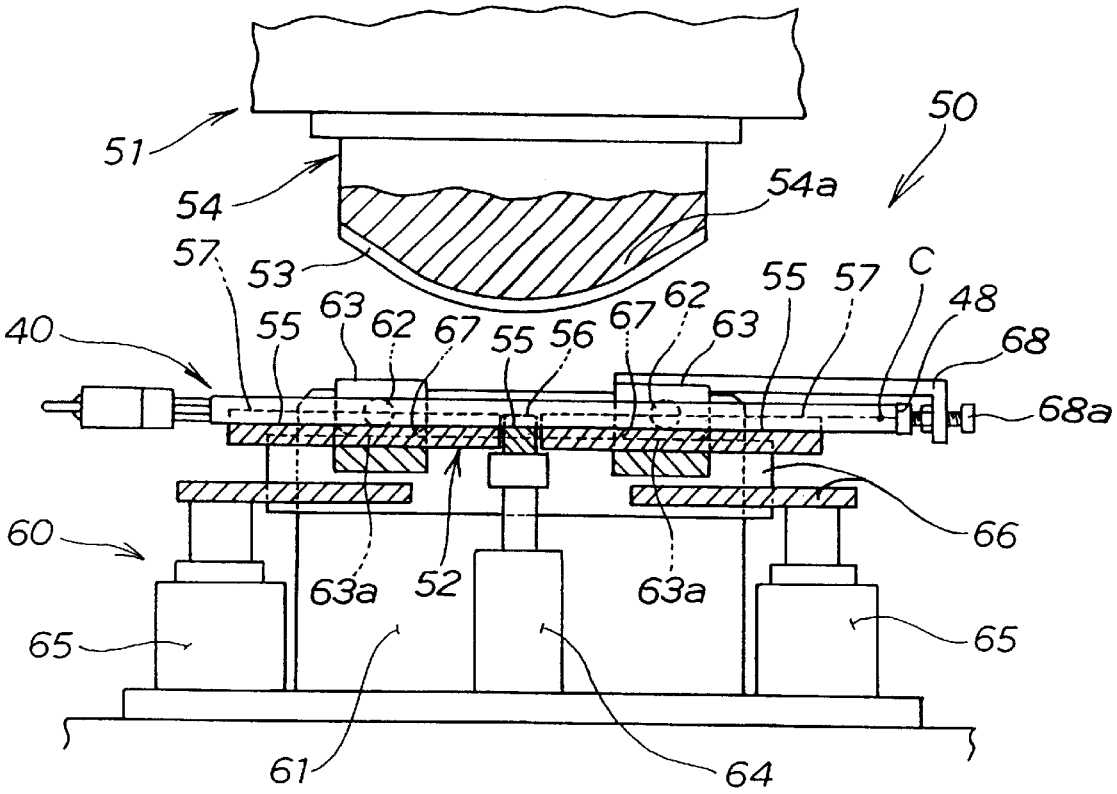
FIG. 2 shows, partly in cross-section, a bender for bending a pipe of rectangular cross-section shown in FIG. 1.

FIG. 2 shows a bender 50 for use in the present invention. The bender 50 has a general-purpose press forming machine 51 including an upper die 54, and a receiving table 60 including a lower die 52.

The upper die 54 includes a lower end 54*a* bent to have a given radius of curvature so as to bend the hollow workpiece 40 into a predetermined configuration. The upper die 54 has an upper die groove 53 along the bent lower end 54*a*. The hollow workpiece 40 is received in the upper die groove 53 when bent along the bent lower end 54*a*.

The receiving table 60 includes a lower die supporting member 61 for supporting the lower die 52. The lower die 52 comprises a center lower die 56 disposed in such a position as to face the lowermost portion of the bent upper die 54, and side lower dies 57, 57 disposed rightwardly and leftwardly of the center lower die 56. The side lower dies 57, 57 have the same level as the center lower die 56. Each of the center lower die 56 and side lower dies 57, 57 includes an upper portion forming a lower die groove 55 extending longitudinally thereof. Each of the lower die grooves 55, 55, 55 is sized to receive therein the hollow workpiece 40.

At an upper part of the lower die supporting member 61, right and left pivoting members 63, 63 pivotal on pins 62, 62 are attached to the right and left side lower dies 57, 57. The hollow workpiece 40 is received in the lower die grooves 55, 55, 55 to horizontally set the former on the center lower die 56 and the right and left side lower dies 57, 57.

Figure 4:
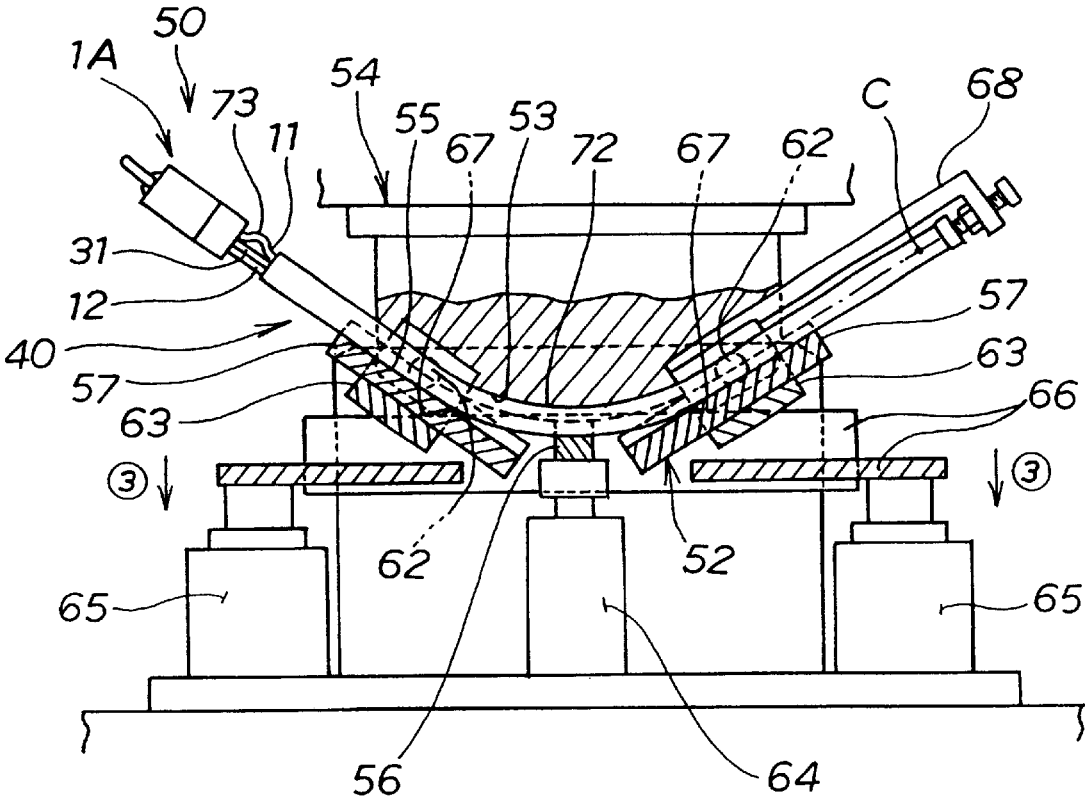
FIG. 4 shows the pipe bent by the bender shown in FIG. 2.

As the upper die 54 is lowered to apply a pressure to the hollow workpiece 40, such pressure is absorbed by a center cylinder 64 provided at a lower end of the center lower die 56. Side cylinders 65, 65 are disposed rightwardly and leftwardly of the center cylinder 64 so as to absorb pressure the upper die 54 exerts on the side lower dies 57, 57. Each of the side cylinders 65, 65 includes a plunger connected to a bumper plate 66. The bumper plate 66 includes an upper side portion which contacts supporting surface portions 63*a*, 63*a* formed on the respective pivoting members 63, 63. The individual pivoting members 63, 63 include pressing corner portions 67, 67 each disposed adjacent to the supporting surface portion 63*a*. The pressing corner portions 67, 67 are curved. When the upper die 54 is lowered to turn the pivoting members 63, 63 as shown in FIG. 4, the pressing corner portions 67, 67 depress the bumper plate 66 as indicated by arrows ③, ③. Thus, the pressure the upper die 54 exerts is absorbed by the side cylinders 65, 65. The right pivoting member 63 is provided with a positioning member 68 for positioning the hollow workpiece 40 in place on the lower die 52 so as to set the hollow workpiece 40 in the bender 50. The positioning member 68 has an adjustment screw 68*a* for finely adjusting the position of the hollow workpiece 40.

Bending of a pipe having a rectangular cross-section now will be described. A pipe 40 of rectangular cross-section having the bead 46 serving as a weld seam on either of the top sheet portion 41 and the bottom sheet portion 42 is initially provided as shown in FIG. 1. In addition, the first, second and third resinous sheets 11, 12, 31 for forming the mandrel in cooperation with each other are provided in preparation for insertion thereof into the pipe 40. Thickness obtained when the first, second, and third resinous sheets 11, 12, 31 are laid one on the other is substantially equal to the inside measurement Y2 between the interior surface 45 of the top sheet portion 41 and the interior surface of the bottom sheet portion 42. The pipe 40 is cut to have a predetermined length L1 is illustrated in FIG. 3A.

Figures 3A, 3B, 3C:
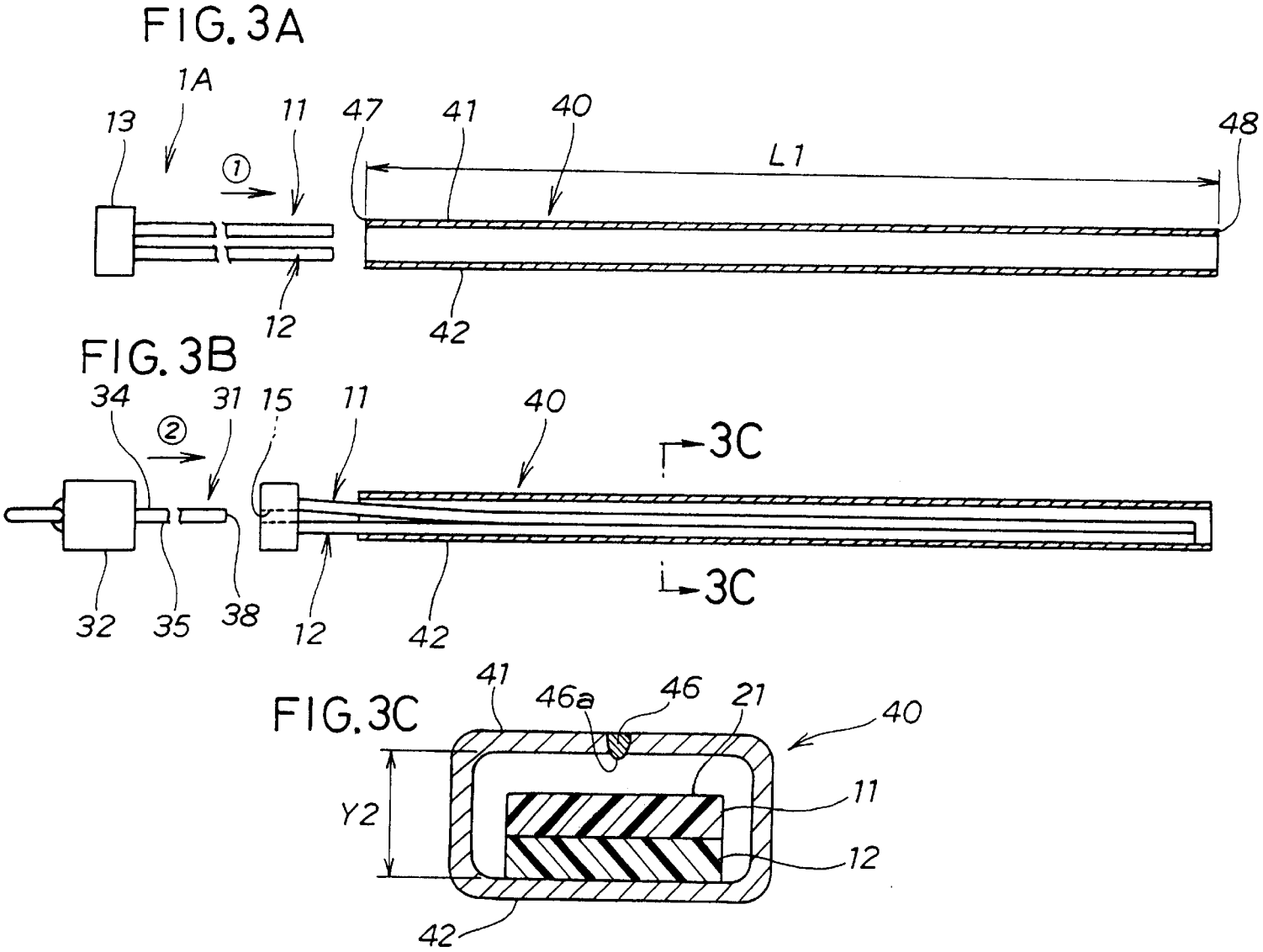
FIGS. 3A through 3E illustrate steps in a method of bending a pipe according to the first embodiment of the present invention.

As shown in FIG. 3A, the first and second resinous sheets 11, 12 for forming the first mandrel segment 10 are inserted into the pipe 40 through the distal end portion 47 as indicated by an arrow ①. Subsequently, the distal end portion 38 of the third resinous sheet 31 for forming the second mandrel segment 30 is disposed in opposed relation to the opening 15 of the supporting member 13, as shown in FIG. 3B. The third resinous sheet 31 is then forced into a spacing between the first and second resinous sheets 11, 12 for forming the first mandrel segment 10, as shown in an arrow ② of FIG. 3B. The back-up surfaces 34, 35 of the third resinous sheet 31 are preferably coated with a lubricant to become smooth.

FIG. 3C is an enlarged cross-sectional view taken along line 3C—3C of FIG. 3B, showing the first and second resinous sheets 11, 12 inserted within the pipe 40 in the manner as described in relation to FIGS. 3A and 3B. Thickness obtained by laying the first resinous sheet 11 on the second resinous sheet 12 is smaller than the inside measurement Y2 of the pipe 40. Therefore, the front surface 21 of the first resinous sheet 11 is out of contact with the projection portion 46*a* of the bead 46. Since the first and second resinous sheets 11, 12 are inserted into the pipe 40 without contact between the projection portion 46*a* of the bead 46 and the first resinous sheet 11 as previously stated, it becomes possible to easily insert the first mandrel segment 10 into the pipe 40.

Figure 3D:
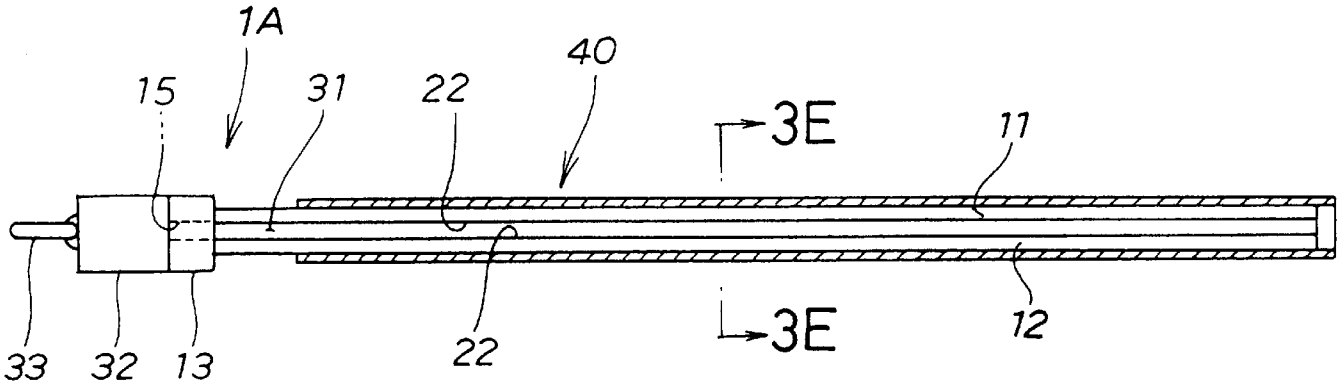

FIG. 3D illustrates the first, second, and third resinous sheets 11, 12, 31 all of which are inserted within the pipe 40. By thus inserting the third resinous sheet 31 between the first and second resinous sheets 11, 12 through the opening 15 in the manner described with reference to FIG. 3B, insertion of the mandrel comprised of the three resinous sheets within the hollow workpiece 40 is accomplished. A step of inserting the mandrel into the hollow workpiece 40 is therefore completed.

Figure 3E:
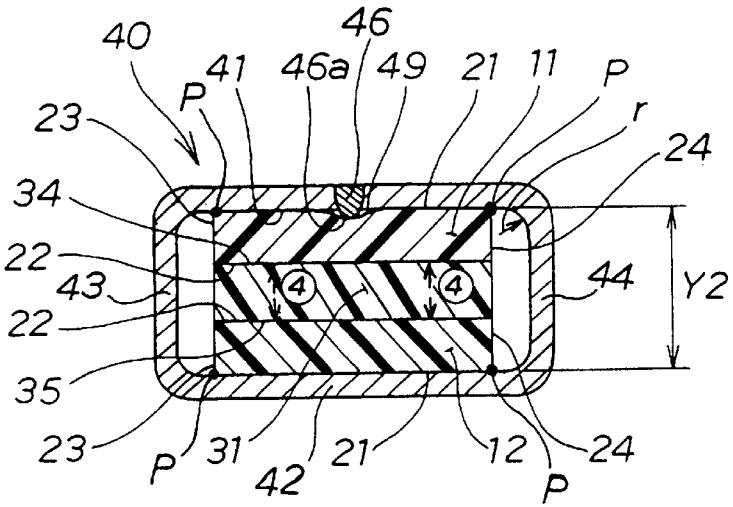

FIG. 3E is an enlarged cross-sectional view taken along line 3E—3E of FIG. 3D. As the third resinous sheet 31 is forcibly inserted between the back surfaces 22, 22 of the first and second resinous sheets 11, 12 as stated above, the front surface 21 of the first resinous sheet 11 comes into intimate contact with the projection portion 46*a* of the bead 46 formed in the top sheet portion 41 of the pipe 40. More specifically, when the third resinous sheet 31 serving as an inner layer sheet is forced into the spacing between the first and second resinous sheets 11, 12 both serving as outer layer sheets, the back-up surface 34 acting as an upper surface of the third resinous sheet 31 is pressed against the first resinous sheet 11 to push the same upwardly while the back-up surface 35 acting as a lower surface of the third resinous sheet 31 is pressed against the second resinous sheet 12 to push the same downwardly, as shown in arrows ④, ④. The front surface 21 acting as an upper surface of the first resinous sheet 11 is in intimate contact with the projection portion 46*a* of the bead 46. By thus brining the first resinous sheet 11 into intimate contact with the projection portion 46*a*, the front surface 21 of the first resinous sheet 11 is recessed by the projection portion 46*a* to thereby form a recessed portion 49. As thus far explained, the first mandrel segment 10 is inserted into the hollow pipe 40 and subsequently the second mandrel segment 30 is inserted into the same to thereby lift up the first resinous sheet 11 of the first the mandrel segment 10. Thus, there is no longer friction between the front surface 21 of the first resinous sheet 11 and the projection portion 46*a* of the bead 46 having a rough surface, thereby preventing the front surface 21 from being damaged or cracked. The third resinous sheet 31 is inserted in such a manner as to slide into the spacing between the first and second resinous sheets 11, 12 both having small friction coefficients. Therefore, the third resinous sheet 31 is not caught or lodged between the first resinous sheet 11 and the second resinous sheet 12 to thereby facilitate the insertion thereof.

The thickness obtained when the first, second and third resinous sheets 11, 12, 31 are laid one on the other is, for example, 26.3 mm. The inside measurement Y2 of the pipe 40 is 27.6 mm as previously described. A difference between such a thickness and the inside measurement Y2 is therefore 1.3 mm. That is, as the three resinous sheets 11, 12, 31 are inserted into the pipe 40 to form the mandrel, such a mandrel is spaced from the interior surfaces of both the top sheet portion 41 and the bottom sheet portion 42. More specifically, gaps are defined between the first resinous sheet 11 and the interior surface 45 of the top sheet portion 41 and between the second resinous sheet 12 and the interior surface of the bottom sheet portion 42. Each gap is 0.65 mm. Since the gap is small, the thickness obtained when the three resinous sheets 11, 12, 31 are laid one on the other is substantially equal to the inside measurement Y2.

All four corner portions of the pipe 40 include inner surfaces bent in such a manner as to all have the same radius of curvature r. The top and bottom sheet portions 41, 42 include the interior surfaces each meeting the bent inner surfaces of the corner portions at intersection points P. A spacing defined by the four intersection points P is sized such that the first and second, and third resinous sheets 11, 12, 31 are inserted thereinto. This makes it unnecessary to chamfer the first and second resinous sheets 11, 12 in conformation to the bent inner surfaces of the corner portions each having the radius of curvature r. Although the interior surface of the right side sheet portion 44 of the pipe 40 and the right side surfaces 24, 24, 37 of the first, second, and third resinous sheets 11, 12, 31 are cooperated with each other to define a spacing while the interior surface of the left side sheet portion 43 of the pipe 40 and the left side surfaces 23, 23, 36 of the first, second, and third resinous sheets 11, 12, 31 are cooperated with each other to define a spacing, such spacings do not affect the quality of the bent pipe 40 because they have the same volume.

After the first, second, and third resinous sheets 11, 12, 31 are assembled together to form the mandrel assembly 1A in the manner as previously described, the hollow workpiece 40 is set in the bender 50 as shown in FIG. 2. More specifically, a proximal end portion 48 of the hollow workpiece 40 abuts against the adjustment screw 68*a* of the positioning member 68 to position the hollow workpiece 40 in place and then the hollow workpiece 40 is received in the respective lower die grooves 55, 55, 55 of the right and left side lower dies 57, 57 and the center lower die 56.

Thereafter, the upper die 54 is lowered to bend the hollow workpiece 40 in such a manner that a center axis C extending longitudinally of the hollow workpiece 40 conforms to the bent upper die groove 53 of the upper die groove 54, as shown in FIG. 4. More specifically, when the upper die 54 is lowered to receive the hollow workpiece 40 in the upper die groove 53, the central part of the hollow workpiece 40 begins to be bent with the center lower die 56 and the center cylinder 64 retaining the hollow workpiece 40.

As the upper die 54 is further lowered to exert a pressure on the hollow workpiece 40 held in the upper die groove 53 and the lower die grooves 55, the hollow workpiece 40 is bent along the bent lower end 54*a* of the upper die 54. The right and left pivoting members 63, 63 rotate on the pins 62, 62 as the upper die 54 is lowered. The hollow workpiece 40 is bent while the bumper plate 66 is depressed by the pressing corner portions 67, 67, as indicated by the arrows ③, ③, upon rotation of the right and left pivoting members 63, 63 on the pins 62, 62. As the hollow workpiece 40 is bent, the first, second, and third resinous sheets 11, 12, 31 (see FIG. 1) serving as the mandrel are also bent to thereby prevent a bent portion 72 of the hollow workpiece 40 from wrinkling. When bending the hollow workpiece 40 within which the mandrel formed by laying the three resinous sheets one on the other is inserted, the gaps are defined between the interior surface of the top sheet portion 41 and the mandrel and between the interior surface of the bottom sheet portion 42 and the mandrel. These gaps are preferably in the order of 0.6 mm to 1.3 mm altogether (each gap is in the order of 0.3 mm to 0.65 mm). Provision of the gaps which are less than 0.6 mm makes it difficult to insert the third resinous sheet 31 between the first resinous sheet 11 and the second resinous sheet 12. When the gaps are more than 1.3 mm, the bent portion 72 of the hollow workpiece 40 is likely to wrinkle.

When the hollow workpiece 40 is bent, the first, second, and third resinous sheets 11, 12, 31 (see FIG. 1) for forming the mandrel in cooperation with each other are also bent as stated above. At this time, with the third resinous sheet 31 inserted between the first and second resinous sheets 11, 12, compressive force is applied to the first resinous sheet 11 along the length thereof while tensile force is applied to the second resinous sheet 12 along the length thereof. Therefore, a portion of the first resinous sheet 11 on the side of the supporting member 13 is flexed to form a flexion 73 to thereby absorb the compressive force applied to the first resinous sheet 11.

When the bending of the hollow workpiece 40 as described above is completed, the upper die 54 is raised and the right and left side lower dies 57, 57 and the center lower die 56 are automatically returned to positions as shown in FIG. 2 by returning forces produced by the cylinders 64, 65, 65. The bent workpiece 40 is subsequently removed from the bender 50.

Figure 5A:
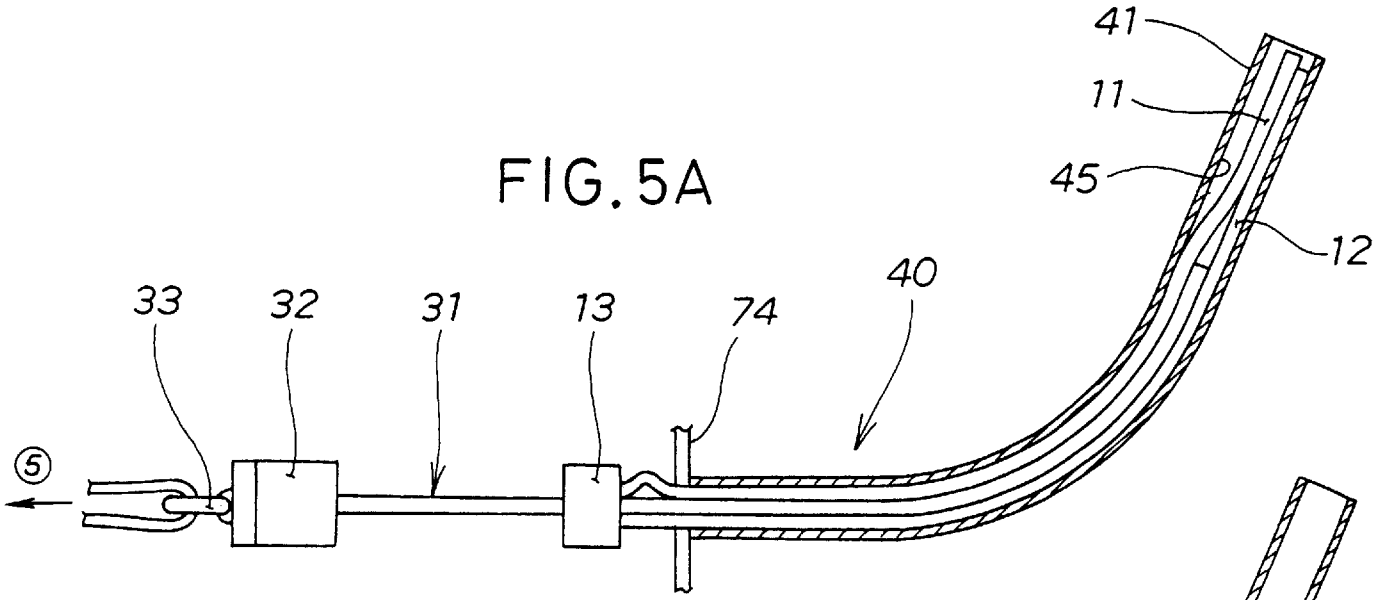
Figure 5B:
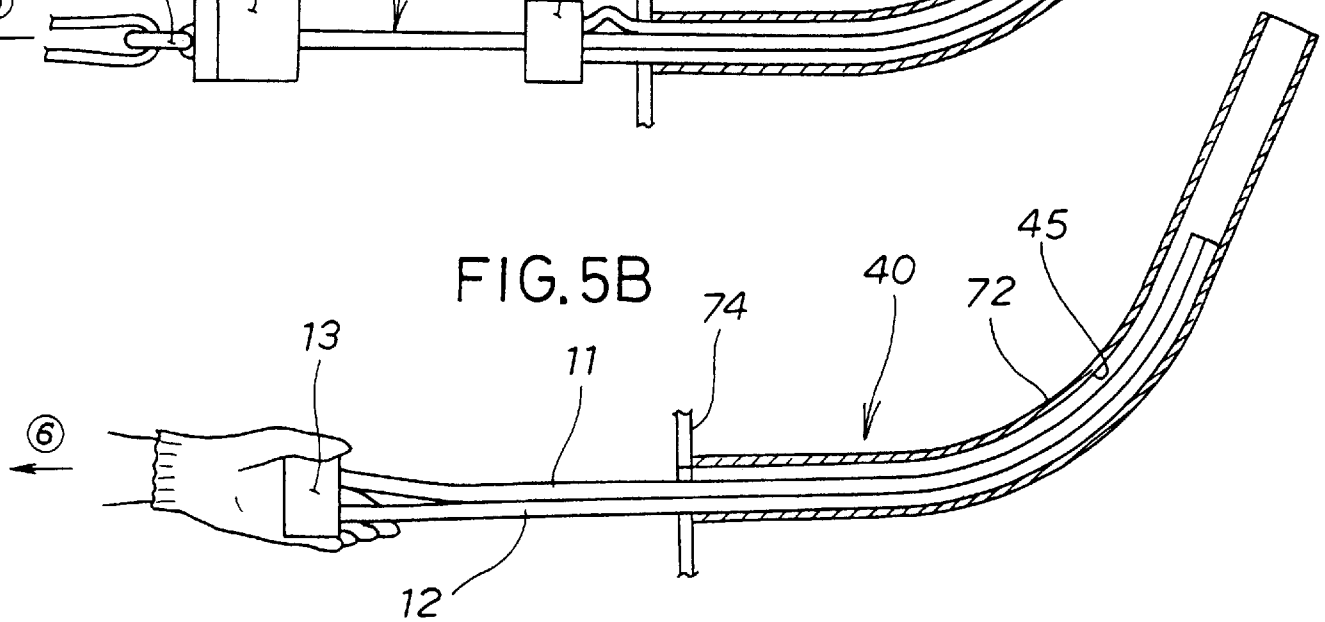
FIG. 5B illustrates first and second resinous sheets pulled out of the bend pipe after the third resinous sheet is pulled out as shown in FIG. 5A.

FIGS. 5A and 5B illustrate how the first, second, and third resinous sheets 11, 12, 31 for forming the mandrel in cooperation with each other are pulled out of the bent hollow workpiece 40.

With the distal end portion of the bent workpiece 40 fixed to a fastening tool 74 of metal so as to prevent the bent workpiece 40 from being shifted, the third resinous sheet 31 is initially pulled out of the bent workpiece 40. More specifically, since the annular handle 33 attached to the holding tool 32 which retains the third resinous sheet 31 is pulled in a direction as shown by an arrow ⑤, the third resinous sheet 31 for forming the second mandrel segment 30 is pulled out of the bent workpiece 40. The front surface 21 of the first resinous sheet 11 is in contact with the projection portion 46*a* of the bead 46 (see FIG. 3E) when the third resinous sheet 31 is pulled out of the bent hollow workpiece 40. The third resinous sheet 31 disposed below the first resinous sheet 11 is thus pulled out of the bent hollow workpiece 40 without contacting the projection portion 46*a* of the bead 46. As a result, the third resinous sheet 11 is prevented from being damaged. Although the third resinous sheet 31 is sandwiched between the first and second resinous sheets 11, 12, the former can be easily pulled out of the bent hollow workpiece 40 because the first and second resinous sheets 11, 12 have small friction coefficients. By thus pulling the third resinous sheet 31 out of the bent hollow workpiece 40, the first resinous sheet 11 comes out of contact with the bead 46.

After the third resinous sheet 31 is pulled out, the first and second resinous sheets 11, 12 for forming the first mandrel segment 10 are pulled out by pulling the supporting member 13 with a hand in a direction as shown by an arrow ⑥ of FIG. 5B. At this time, because the first resinous sheet 11 is not in contact with the projection portion 46*a* of the bead 46, the first mandrel segment 10 can be readily pulled out of the bent hollow workpiece 40 without being caught by the projection portion 46*a* of the bead 46.

Figure 6:
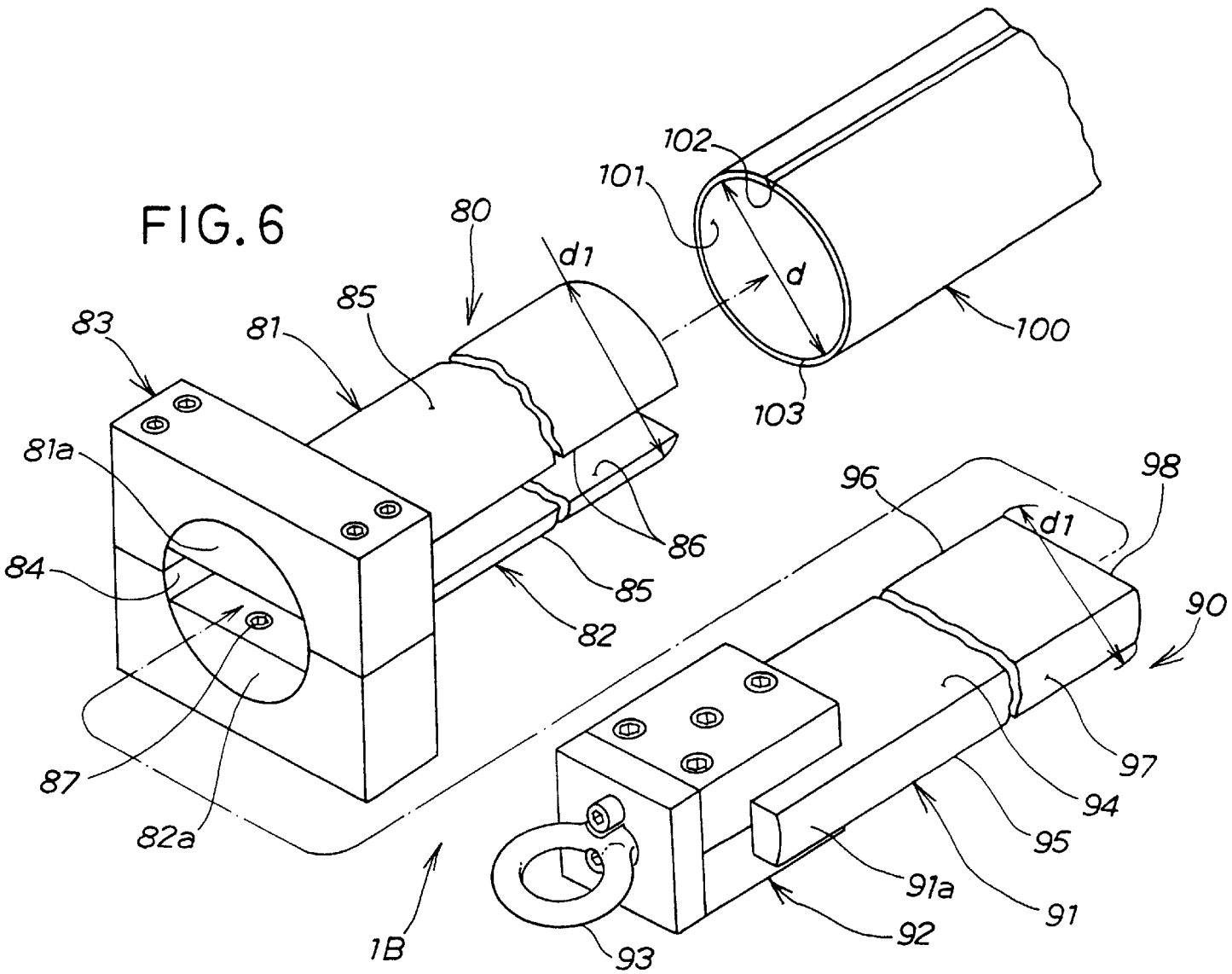
FIG. 6 is a mandrel assembly for use with a pipe of circular cross-section for use in a second embodiment of the present invention.

FIG. 6 illustrating a mandrel assembly 1B for use in a hollow workpiece 100 to be bent according to a second embodiment of the present invention. The hollow workpiece 100 is a pipe of circular cross-section having an inner diameter d. The mandrel assembly 1B includes a first mandrel segment 80 and a second mandrel segment 90.

The first mandrel segment 80 comprises bar-shaped elongated first and second resinous members 81, 82 of semicircle-like cross-section (hereinafter referred to as first and second resinous sheets 81, 82 in correspondence to those in the first embodiment). The first and second resinous sheets 81, 82 have proximal ends 81*a*, 82*a*, respectively, vertically disposed a given interval away from each other and are made of, for example, polyamide.

The proximal ends 81*a*, 82*a* spaced from each other by the given interval are firmly attached to a supporting member 83 through screws 87, 87 (the screw 87 disposed in the proximal end 81*a* is not shown). The supporting member 83 has an opening 84 defined between the first resinous sheet 81 and the second resinous sheet 82. The opening 84 is sized such that the second mandrel segment 90 is inserted thereinto.

The first and second resinous sheets 81, 82 of semicircle-like cross-section include arced outer peripheral surface 85, 85, and flat surfaces 86, 86 opposed to each other. The outer peripheral surface 85 of either of the first and second resinous sheets 81, 82 is disposed to contact a bead 102 serving as a seam of the pipe 100. The outer peripheral surfaces 85, 85 are designed to form arcs of a circle having a diameter d1 slightly smaller than the inner diameter d of the pipe 100.

The second mandrel segment 90 is comprised of a third resinous sheet 91 to be inserted into the opening 84. The third resinous sheet 91 as well as the first and second resinous sheets 81, 82 is made of resin of polyamide. The third resinous sheet 91 includes a proximal end 91*a* sandwiched between two members of a holding tool 92 of metal. The holding tool 92 has an annular handle 93. The third resinous sheet 91 includes back-up surfaces 94, 95, a left side surface 96, a right side surface 97, and a distal end 98. Upon insertion of the third resinous sheet 91 between the first and second resinous sheets 81, 82, the back-up surfaces 94, 95 act to push the first and second resinous sheets 81, 82 upwardly and downwardly. The right and left side surfaces 97, 96 are arced and cooperate with the outer peripheral surfaces 85, 85 of the first and second resinous sheets 81, 82 to provide a circular cross-section having the inner diameter d1 when the third resinous sheet 91 is forced into a spacing between the first and second resinous sheets 81, 82.

The hollow workpiece 100 is the pipe of circular cross-section, as previously described. The pipe 100 includes the bead 102 extending longitudinally thereof. The bead 102 include a projection or bulged portion 102*a* protruding from an inner surface 101 of the pipe 100. The pipe 100 is typically produced as follows. A flat strip article is formed into a cylindrical article by roll forming. The cylindrical article includes opposite edges extending longitudinally thereof. The opposite ends are then butted against each other. Afterwards, the butted opposite ends are joined together by seam welding along the entire length thereof to thereby provide the pipe 100. Reference numeral 103 denotes a distal end portion through which the first and second mandrel segments 80, 90 are inserted into the pipe 100.

Figure 7A:
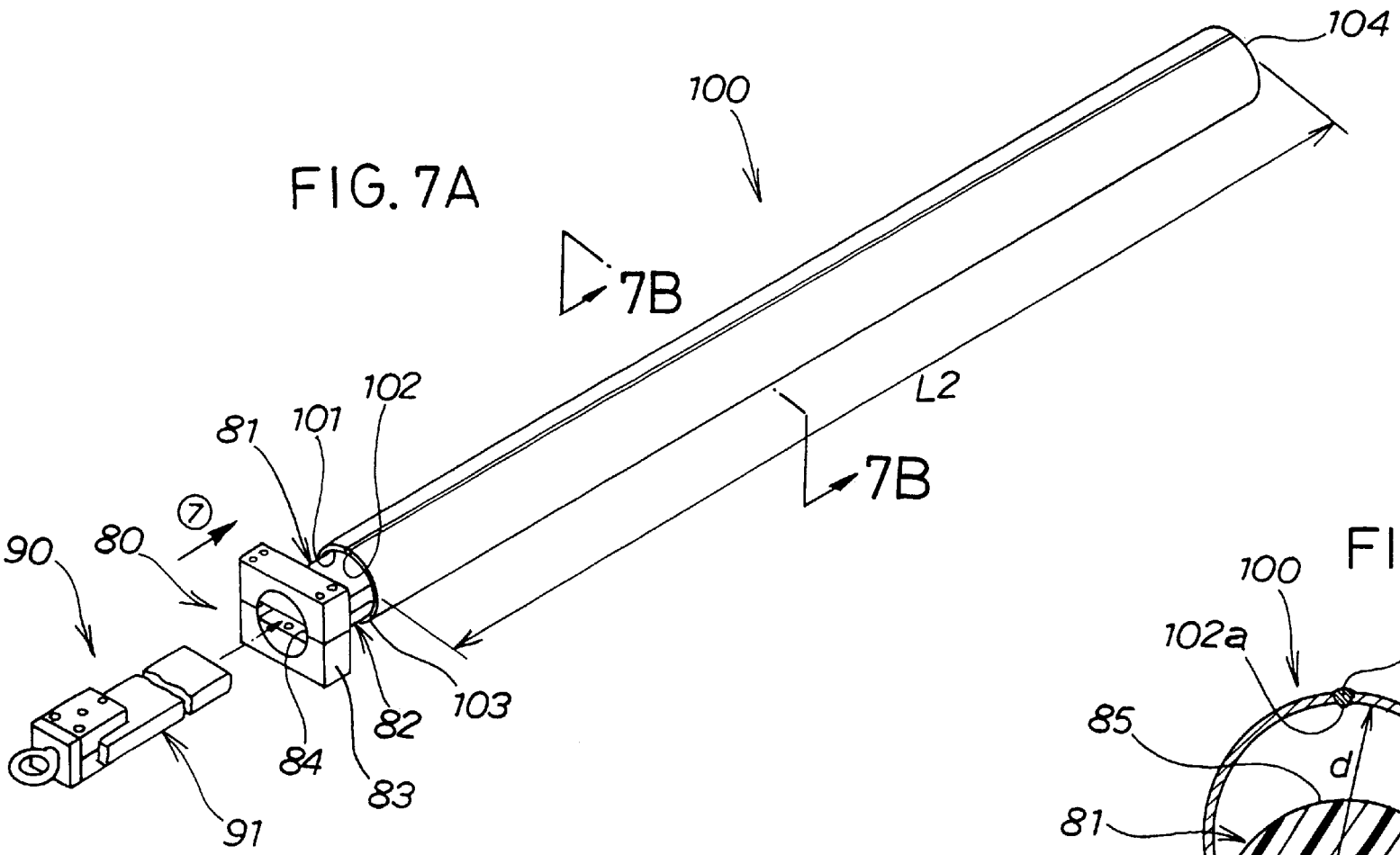
FIGS. 7A through 7D illustrate steps in a method of bending a pipe of circular cross-section according to the second embodiment of the present invention.

A step of bending the pipe 100 in the second embodiment of the present invention will be described below. The pipe 100 including the bend 102 serving as a weld seam extending longitudinally thereof is initially provided, as shown in FIG. 7A. The pipe 100 is cut to have a predetermined length L2. The first, second, and third resinous sheets 81, 82, 91 for forming a mandrel in cooperation with each other are then provided in preparation for insertion thereof into the pipe 100. The mandrel obtained by laying the first, second, and third resinous sheets 81, 82, 91 one on the other is designed to have a circular cross-section having the diameter d1 slightly smaller than the inner diameter d of the pipe 100. However, the diameter d1 is substantially equal to the inner diameter d.

As illustrated in FIG. 7A, the first and second resinous sheets 81, 82 for forming the first mandrel segment 80 in cooperation with each other are inserted into the pipe 100 through the distal end portion 103 as indicated by an arrow ⑦. The pipe 100 includes a proximal end portion 104 for use in positioning the pipe 104 in the bender 50 shown in FIG. 2.

Figure 7B:
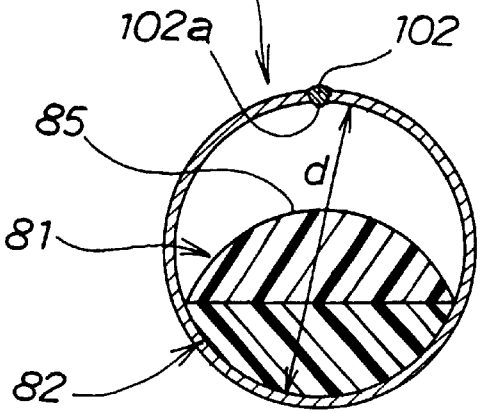

FIG. 7B illustrates an enlarged cross-section of the pipe 100 and the first mandrel segment 80 comprised of the first and second resinous sheets 81, 82 inserted into the pipe 100. The thickness obtained by laying the first resinous sheet 81 on the second resinous sheet 82 is smaller than the inner diameter d of the pipe 100. Thus, the outer peripheral surface 85 of the first resinous sheet 81 does not contact the bulged portion 102*a* of the bead 102 as the first and second resinous sheets 81, 82 alone are inserted into the pipe 100. Because the bulged portion 102*a* of the bead 102 do not contact the first resinous sheet 81 to thereby provide no resistance to the insertion of the first resinous sheet 81. Consequently, the first mandrel segment 80 can be readily inserted into the pipe 100.

Figures 7C, 7D:
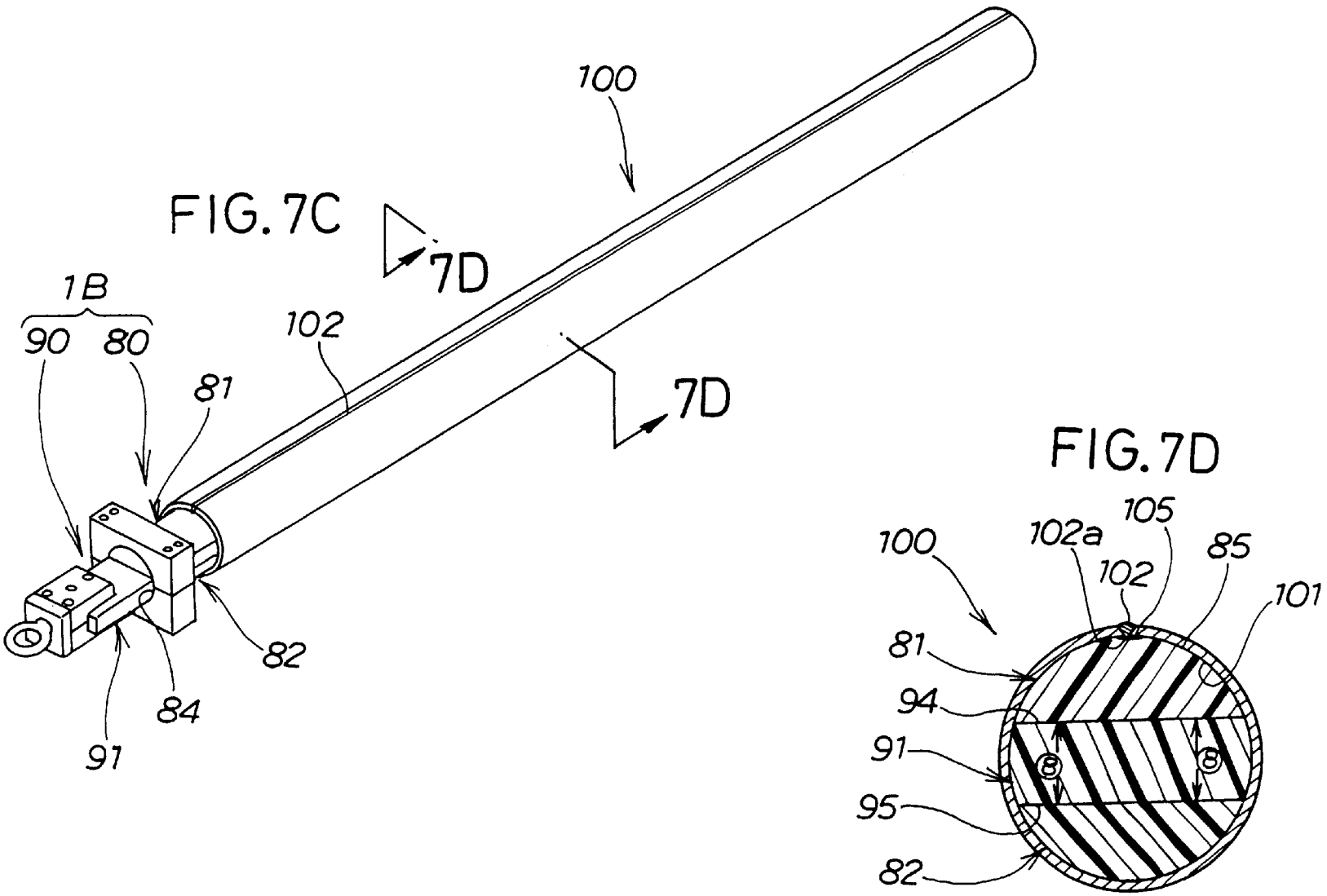

With the first and second resinous sheets 81, 82 inserted within the pipe 100 as shown in FIG. 7B, the third resinous sheet 91 for forming the second mandrel segment 90 is forced through the opening 84 of the supporting member 83 in a direction as shown in a chain line of FIG. 7A, thereby providing the third resinous sheet 91 inserted within the pipe 100, as shown in FIG. 7C.

By such an insertion of the third resinous sheet 91, the first resinous sheet 81 is pushed upwardly while the second resinous sheet 82 is pushed downwardly, as indicated by arrows ⑧, ⑧. At this time, the outer peripheral surface 85 of the first resinous sheet 81 is in intimate contact with the bulged portion 102*a* of the bead 102 of the pipe 100. By such an intimate contact between the outer peripheral surface 85 of the first resinous sheet 81 and the bulged portion 102*a* of the bead 102 of the pipe 100, the bulged portion 102*a* of the bead 102 recess the outer peripheral surface 85 of the first resinous sheet 81 to thereby provide a recessed portion 105 to the outer peripheral surface 85.

As the first, second, and third resinous sheets 81, 82, 91 are laid one on the other to form the mandrel in the manner as stated above, the outer peripheral surface of the mandrel is substantially in contact with the inner surface 101 of the pipe 100. In the second embodiment as well as the first embodiment employing the pipe 40, a gap may be provided between the inner surface 101 of the pipe 100 and the outer peripheral surface of the mandrel comprised of the first, second, and third resinous sheets 81, 82, 91.

After insertion of the first, second and third resinous sheets 81, 82, 91 into the pipe 100, the pipe 100 is bent using the bender 50 shown in FIG. 2 such that the pipe 100 has a predetermined bend radius. Since the pipe 100 in the second embodiment is bent in the same manner as the pipe 40 described in the first embodiment, their descriptions are omitted. However, it is required that dies or the like for the pipe 100 be employed.

After the pipe 100 is bent, the third resinous sheet 91 is first pulled out of the bent pipe 100 in the same manner as the third resinous sheet 31 in the first embodiment as shown in FIG. 5A. By pulling out the third resinous sheet 91, the first resinous sheet 81 comes out of contact with the bulged portion 102*a* of the bend 102. Therefore, the first mandrel segment 80 comprised of the first and second resinous sheets 81, 82 can be readily pulled out of the bent pipe 100.

Figure 8:
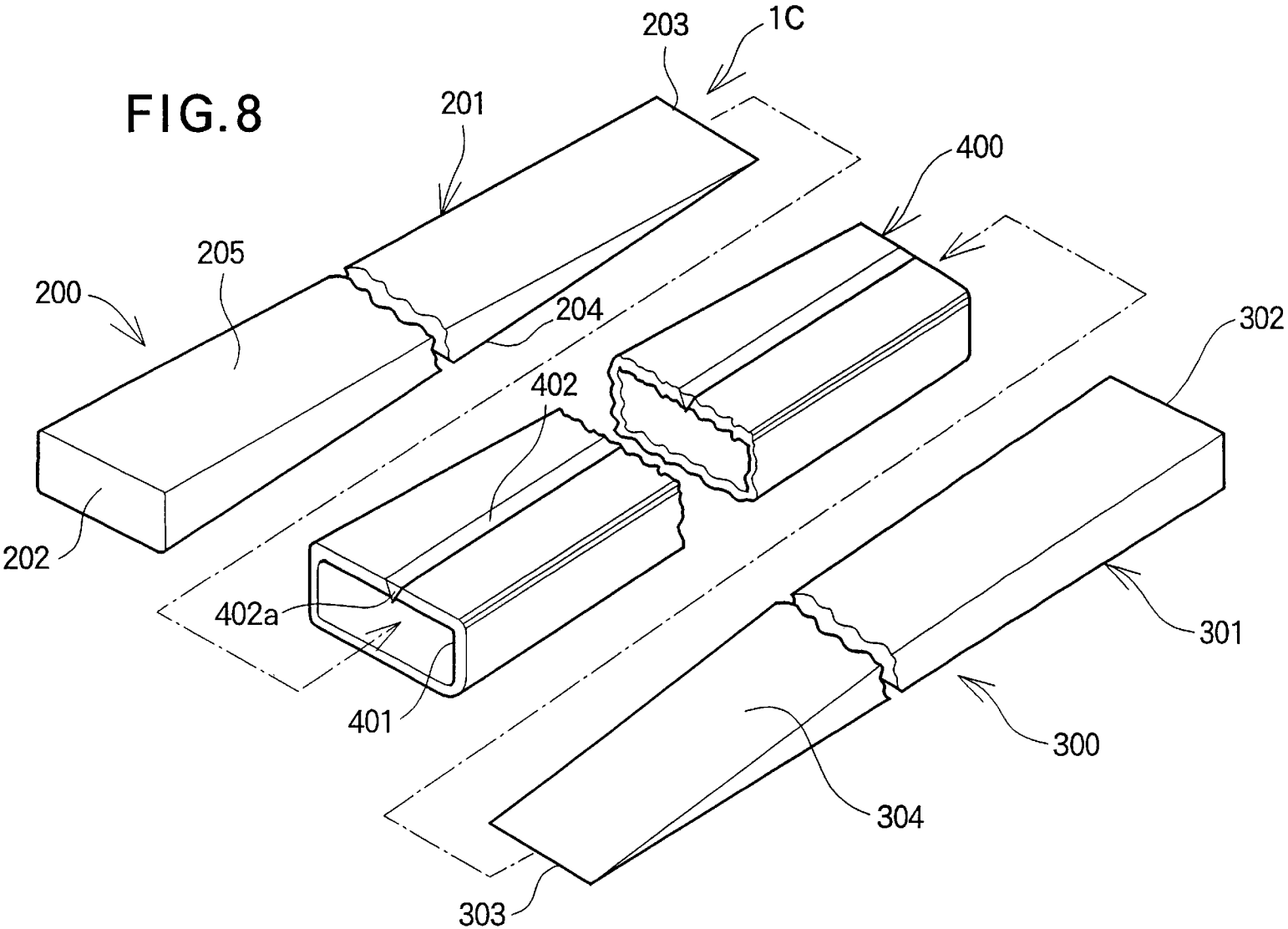
FIG. 8 is a perspective view of a mandrel assembly for a pipe of rectangular cross-section according to a third embodiment of the present invention.
Figure 9:
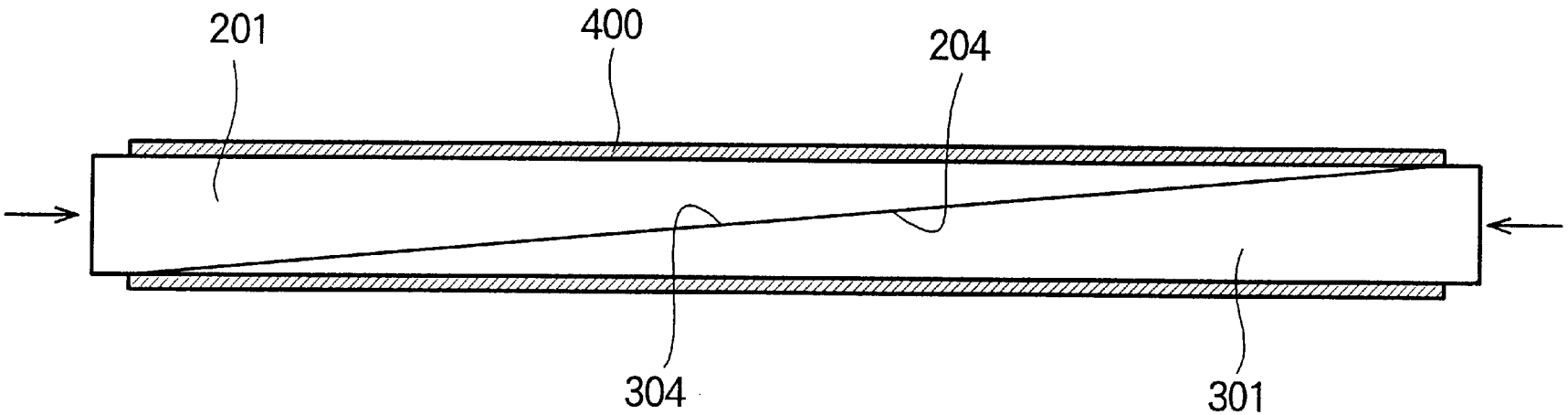
FIG. 9 is a cross-sectional view showing the mandrel assembly of FIG. 8 inserted into the pipe.

In FIGS. 8 and 9, there is shown a mandrel assembly according to a third embodiment of the present invention. Although the first and second embodiments employ the mandrel assemblies each divided into three resinous sheets extending longitudinally thereof, the mandrel assembly in the third embodiment is divided into two resinous sheets longitudinally thereof.

Referring to FIG. 8, a mandrel assembly 1C includes a first mandrel segment 200 and a second mandrel segment 300. The first mandrel segment 200 comprises a wedge-shaped first resinous sheet 201 including a lower ramp surface 204 sloping from a proximal end 202 toward a distal end 203. The second mandrel segment 300 comprises a wedge-shaped second resinous sheet 301 including an upper ramp surface 304 sloping from a proximal end 302 toward a distal end 303. When the first resinous sheet 201 is laid on the second resinous sheet 301 with the lower ramp surface 204 of the first resinous sheet 201 and the upper ramp surface 304 of the second resinous sheet 301 mated together to thereby form a mandrel, the mandrel includes an outer peripheral surface substantially conforming in contour to an inner surface 401 of a pipe 400 of rectangular cross-section for use as a hollow workpiece to be bent.

The upper ramp surface 304 of the second resinous sheet 301 serves as the back-up surface as described in the first or second embodiment of the present invention. More specifically, when the second resinous sheet 301 is inserted into the pipe 400 having the first resinous sheet 201 previously inserted therewithin, the first resinous sheet 201 is pushed upwardly by the upper ramp surface 304 of the second resinous sheet 301. An upper flat surface 205 of the first resinous sheet 201 then contacts a bulged portion 402*a* protruding inwardly from a bead 402 serving as a weld seam of the pipe 400.

The insertion of the mandrel segments into the pipe 400 is started by inserting the first resinous sheet 201 into the pipe 400 through one side of the pipe 400. As the first resinous sheet 201 is inserted into the pipe 400, the distal end 203 is first inserted into the pipe 400 in such a manner that the upper flat surface 205 of the first resinous sheet 201 is opposed to the bead 402 of the pipe 400. Because the upper ramp surface 204 slopes from the proximal end 202 toward the distal end 203 as far described, the first resinous sheet 201 becomes smaller in thickness. Therefore, the upper flat surface 205 does not contact the bulged portion 402*a* of the bead 402 during insertion of the first resinous sheet 201.

After the insertion of the first resinous sheet 201 into the pipe 400 is completed, the second resinous sheet 301 is forced into the pipe 400 through the side opposite to the one side through which the first resinous sheet 201 is previously inserted into the pipe 400. More specifically, the distal end 303 of the second resinous sheet 301 is forced into a gap formed by slightly lifting up the distal end 203 of the first resinous sheet 201 (see FIG. 9).

The pipe 400 having the first and second resinous sheets 201, 301 thus inserted therewithin is set in the bender 50 as shown in FIG. 2. Then, the pipe 400 is bent as illustrated in FIG. 4. The pipe 400 is bent in the manner as described in the first embodiment.

After the bending of the pipe 400 is completed, the mandrel segments are pulled out of the pipe 400 as follows. The second resinous sheet 301 is initially pulled out of the bent pipe 400. The first resinous sheet 201 is then pulled out of the bent pipe 400. When the second resinous sheet 301 is pulled out of the bent pipe 400, the distal end 203 of the first resinous sheet 201 is lowered to thereby bring the upper flat surface 205 out of contact with the bulged portion 402*a* of the bead 402 of the bent pipe 400. Thus, the upper flat surface 205 is not damaged by the bulged portion 402*a* of the bead 402 as the first resinous sheet 201 is pulled out of the bent pipe 400.

The pipe 400 as shown in FIGS. 8 and 9 has the same configuration as the pipe 40 illustrated in the first embodiment. It will be appreciated that a pipe having a circular cross-section as well as a rectangular cross-section may be employed in the third embodiment. When the pipe is circular in cross-section, a mandrel for use with such a pipe is obliquely divided into first and second mandrel segments.

Although the hollow workpieces are rectangular and circular in cross-section in the first, second, and third embodiments, they may be oval or trapezoidal in cross-section.

Obviously, various minor changes and modifications of the present invention are possible in the light of the above teaching. It is therefore to be understood that within the scope of the appended claims, the present invention may be practiced otherwise than as specifically described.

What is claimed is:

1. A method for bending a pipe with a mandrel inserted thereinto, said pipe having a weld seam extending longitudinally thereof, said weld seam including a bulged portion protruding inwardly of said pipe, said method comprising the steps of:

providing first, second and third resinous sheets for forming said mandrel, having an overall thickness corresponding to an inside measurement of said pipe;

inserting said first and second resinous sheets into said pipe;

fixedly holding proximal ends of said first and second resinous sheets such that an opening is defined between said proximal ends of said first and second resinous sheets;

inserting said third resinous sheet into said pipe through said opening such that a surface of one of said first and second resinous sheets comes into intimate contact with said bulged portion;

actuating a bender to apply pressure to said pipe to thereby bend said pipe with said first, second and third resinous sheets inserted thereinto;

pulling said third resinous sheet out of said bent pipe; and then, pulling said first and second resinous sheets out of said bent pipe.

2. A method for bending a pipe, as claimed in claim 1, wherein said pipe is circular in cross-section.

3. A method for bending a pipe of rectangular cross-section with a mandrel inserted thereinto, said pipe including top and bottom sheets either of which has a weld seam extending longitudinally thereof, said weld seam having a bulged portion protruding inwardly from said top or bottom sheet, said method comprising the steps of:

providing first, second and third resinous sheets for forming said mandrel, having an overall thickness corresponding to an inside measurement between said top and bottom sheets of said pipe;

inserting said first and second resinous sheets into said pipe;

fixedly holding proximal ends of said first and second resinous sheets such that an opening is defined between said proximal ends of said first and second resinous sheets;

inserting said third resinous sheet into said pipe through said opening such that a surface of one of said first and second resinous sheets comes into intimate contact with said bulged portion;

actuating a bender to apply pressure to said top or bottom sheet of said pipe to thereby bend said pipe with said first, second and third resinous sheets inserted thereinto;

pulling said third resinous sheet out of said bent pipe; and then, pulling said first and second resinous sheets out of said bent pipe.

4. A mandrel assembly designed to be inserted into a pipe for bending the pipe, said pipe having a weld seam extending longitudinally thereof, said weld seam including a bulged portion protruding inwardly of said pipe, said mandrel assembly comprising:

a first mandrel segment comprised of first and second resinous sheets and a supporting member supporting proximal ends of said first and second resinous sheets such that an opening is defined between said proximal ends of said first and second resinous sheets; and a second mandrel segment comprised of a third resinous sheet and a holding tool holding a proximal end of said third resinous sheet, said third resinous sheet inserted between said first and second resinous sheets through said opening to cause said first and second resinous sheets to move away from each other until a surface of one of said first and second resinous sheets comes into intimate contact with said bulged portion, said holding tool being positioned more remote from said pipe than said supporting member and in abutting relation to said supporting member when said third resinous sheet is inserted between said first and second resinous sheets within said pipe.

5. A mandrel assembly as claimed in claim 4, wherein said first, second and third resinous sheets when inserted into said pipe, have an overall thickness substantially equal to an inside measurement of said pipe.

6. A mandrel assembly as claimed in claim 4, wherein when said pipe is rectangular in cross-section, said first, second, and third resinous sheets are flat resinous sheets.

7. A mandrel assembly as claimed in claim 4, wherein when said pipe is circular in cross-section, each of said first and second resinous sheets has a flat surface and an arced surface such that each cross-section of said first and second resinous sheets is sized in substantial correspondence to an inner diameter of said pipe while said third resinous sheet is a flat resinous sheet having opposite side surfaces arced in substantial correspondence to said inner diameter of said pipe.

* * * * *